US011591879B2

(12) United States Patent
Least et al.

(10) Patent No.: US 11,591,879 B2
(45) Date of Patent: Feb. 28, 2023

(54) THERMOPLASTIC WITH SWELLABLE METAL FOR ENHANCED SEAL

(71) Applicant: Halliburton Energy Services, Inc., Houston, TX (US)

(72) Inventors: Brandon T. Least, Carrollton, TX (US); Michael L. Fripp, Carrollton, TX (US); Chad W. Glaesman, Denison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 86 days.

(21) Appl. No.: 17/161,902

(22) Filed: Jan. 29, 2021

(65) Prior Publication Data

US 2022/0243552 A1 Aug. 4, 2022

(51) Int. Cl.
*E21B 33/12* (2006.01)
*E21B 33/134* (2006.01)

(52) U.S. Cl.
CPC ..... *E21B 33/1208* (2013.01); *E21B 33/134* (2013.01)

(58) Field of Classification Search
CPC ..... E21B 33/1208; E21B 33/134
See application file for complete search history.

(56) References Cited

U.S. PATENT DOCUMENTS 8,960,315 B2 * 2/2015 Nutley ..... E21B 33/1208 166/387
9,617,821 B2 * 4/2017 Solhaug ..... E21B 33/127
10,584,564 B2 * 3/2020 Sherman ..... C08K 3/22
10,724,340 B2 * 7/2020 Fripp ..... E21B 37/06
2008/0149351 A1 6/2008 Marya et al.
2012/0175134 A1 7/2012 Robisson et al.
2020/0240235 A1 7/2020 Fripp et al.
2020/0325749 A1 10/2020 Fripp et al.
2021/0363852 A1 * 11/2021 Fripp ..... E21B 33/1208

FOREIGN PATENT DOCUMENTS

CN 104583530 A 4/2015
GB 2482078 A * 1/2012 ..... E21B 33/00
WO WO-2018102196 A1 * 6/2018 ..... C08K 3/08
WO 2019164492 A1 8/2019
WO 2019164499 A1 8/2019
WO 2020018110 A1 1/2020
WO 2020068037 A1 4/2020
WO 2020171825 A1 8/2020

(Continued)

OTHER PUBLICATIONS

Electronic Filing Acknowledgment Receipt, Specification and Drawings for International Application No. PCT/US2019/058464, entitled "Expandable Metal Wellbore Anchor," filed Oct. 29, 2019, 31 pages.

(Continued)

*Primary Examiner* — Aaron L Lembo
(74) *Attorney, Agent, or Firm* — Conley Rose, P.C.; Rodney B. Carroll

(57) ABSTRACT

Swellable metal assemblies that have a reactive metal and a polymer, and are located around or inside an oilfield tubular. The oilfield tubular and the swellable metal assembly can be provided in a wellbore to form a seal therein.

19 Claims, 6 Drawing Sheets

(56) References Cited

FOREIGN PATENT DOCUMENTS

WO 2021011013 A1 1/2021

OTHER PUBLICATIONS

Electronic Filing Acknowledgment Receipt, Specification and Drawings for International Application No. PCT/US2019/0061526, entitled "Expandable Metal Packing Stacks," filed Nov. 14, 2019, 25 pages.
Electronic Filing Acknowledgment Receipt, Specification and Drawings for International Application No. PCT/US2019/058904, entitled "Running Lines through Expandable Metal Sealing Elements," filed Oct. 30, 2019, 42 pages.
Electronic Filing Acknowledgment Receipt, Specification and Drawings for International Application No. PCT/US2019/056814, entitled "Washout Prevention Element for Expandable Metal Sealing Elements," filed Oct. 17, 2019, 40 pages.
Electronic Filing Acknowledgment Receipt, Specification and Drawings for U.S. Appl. No. 16/718,727, entitled "Reactive Metal Sealing Elements for a Linear Hanger," filed Dec. 18, 2019, 37 pages.
Electronic Filing Acknowledgment Receipt, Specification and Drawings for International Application No. PCT/US2019/047529, entitled "An Expandable Metal Sealant Wellbore Casing Patch," filed Aug. 21, 2019, 18 pages.
Electronic Filing Acknowledgment Receipt, Specification and Drawings for International Application No. PCT/US2020/020530, entitled "Expandable Metal Fishing Tool," filed Feb. 28, 2020, 35 pages.
Electronic Filing Acknowledgment Receipt, Specification and Drawings for International Application No. PCT/US2020/066042, entitled "Expandable Metal Slurry for Wellbore Isolation and Sealing," filed Dec. 18, 2020, 35 pages.
Foreign Communication from Related Application—International Search Report and Written Opinion of the International Searching Authority, International Application No. PCT/US2021/016371, dated Oct. 19, 2021, 10 pages.
Electronic Filing Acknowledgment Receipt, Specification and Drawings for International Application No. PCT/US2021/026890, entitled "Expandable Metal as Backup for Elastomeric Elements," filed Apr. 12, 2021, 31 pages.

* cited by examiner

THERMOPLASTIC WITH SWELLABLE METAL FOR ENHANCED SEAL

TECHNICAL FIELD

This present disclosure relates generally to seals formed by a swellable metal in a wellbore that is formed in a subterranean formation.

BACKGROUND

When drilling a wellbore into a subterranean formation for the purposes of hydrocarbon or other fluid recovery from a subterranean formation, seals can be provided in the annulus between an oilfield tubular and the wellbore or casing for various purposes. Seals can also be provided inside an oilfield tubular for various purposes.

Corrosion from high salinity and/or high temperature environments is an ongoing challenge with seal integrity. Moreover, wellbore operations can be affected until the seal is formed; thus, faster sealing times can improve wellbore operations.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
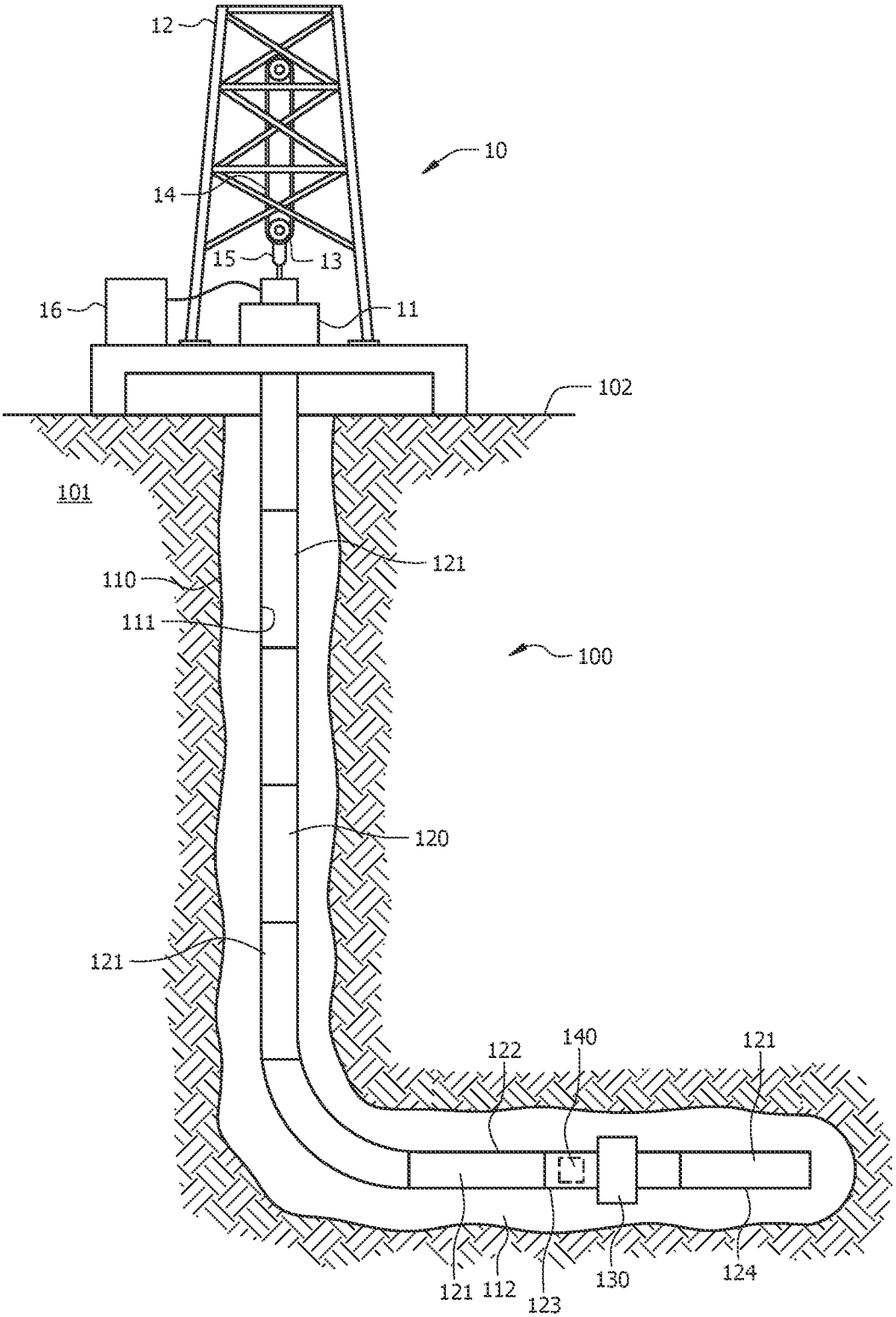
FIG. 1 is a cross-sectional view of a wellbore in an onshore wellbore environment.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein are methods, assemblies, and systems that utilize reactive metal and polymer, where the reactive metal hydrates in wellbore fluids, i.e., in-situ of a wellbore, to form a seal with resulting reaction product and polymer. The methods, assemblies, and systems disclosed herein are particularly useful for use in the annulus formed between an oilfield tubular and the inner wall of the wellbore or a casing, as well as inside the oilfield tubular. It is believed that swellable metal assemblies and the systems and methods that utilize a polymer in combination with the reactive metal, as disclosed herein, can provide structural integrity to the seal that is formed in the wellbore, as well as to the reaction product during formation of the seal in the wellbore. That is, incorporation of a polymer in the configurations disclosed herein results in a functional packer or plug faster than reactive metal assemblies that do not incorporate the disclosed polymer.

In the presence of wellbore fluids that contain water, atoms of the reactive metal reacts with molecules of water to produce a product having a volume that is greater than the volume of the reactive metal itself. The general reaction is:

$$R+2H_2O \rightarrow R(OH)_2+H_2$$

where R is the atom of reactive metal, $H_2O$ is a molecule of water, $H_2$ is hydrogen, and $R(OH)_2$ is a hydroxide compound containing the reactive metal R. The reaction, which can be referred to as a hydration reaction, produces the metal hydroxide; and a metal hydroxide particle has a larger volume than the reactive metal particle from which it is created. The reactive metals disclosed herein can be utilized in swellable metal assemblies that are placed around (for packer configurations) or inside (for plug configurations) an oilfield tubular that is provided in the wellbore. The reactive metal can be embodied in any shape or form, such as an annular sleeve (for a packer), a solid cylindrical body (for a plug), or a solid spherical body (for a plug). The polymer can be utilized in swellable metal assemblies in contact with at least a portion of the reactive metal. The polymer can be embodied in any shape or form, such as a polymer ring, a polymer tape, a sleeve having holes formed therein, or end caps for the reactive metal piece. In these contexts, the reactive metal can be used in presence of a wellbore fluid containing water to create metal hydroxide particles that cause the reactive metal to convert to a reaction product that provides a seal i) in the annulus between the oilfield tubular and the inner surface of the wellbore or casing or ii) inside an oilfield tubular.

FIG. 1 illustrates a wellbore environment 100 in which swellable metal assemblies are utilized according to the disclosed embodiments. For explanatory purposes, the wellbore environment 100 is illustrated in conjunction with an onshore oil and gas platform 10 at the surface 102 of the Earth; however, it is to be understood that the wellbore environment 100 can be used in conjunction with offshore platforms. The oil and gas platform 10 can include a hoisting apparatus 11, a derrick 12, a travel block 13, a hook 14, a swivel 15 for raising and lowering oilfields tubulars into the wellbore 110, and other surface equipment 16 for pumping fluid into the wellbore 110 (e.g., via tubular string 120, discussed in more detail below). The wellbore environment 100 generally includes a wellbore 110 that is formed in a subterranean formation 101, with both the wellbore 110 and the subterranean formation 101 being illustrated in cross-sectional view in FIG. 1. The wellbore 100 has an inner wall 111 that may be bare (open hole), may having a casing cemented thereon, or the wellbore 100 may contain one or more portions in which the inner wall 111 is open hole and one or more other portions in which the inner wall 111 has casing cemented thereon. While the wellbore 110 is shown having a portion extending generally vertically into the subterranean formation 101 (e.g., vertically oriented) and another portion extending generally horizontally into the subterranean formation 101 (e.g., horizontally oriented), the disclosure is also applicable to wellbores having a section that extends at an angle through the subterranean formation 101, such as a slanted section of the wellbore 110. The term "vertically oriented" as used herein may refer to a section of the wellbore 110 that has a longitudinal axis that may be exactly vertical or may extend at an angle with respect to vertical that is +/−89°, and similarly, the term "horizontally oriented" as used herein may refer to a section of the wellbore 110 that has a longitudinal axis that may be exactly horizontal or may extend at an angle with respect to horizontal that is +/−89°.

In FIG. 1, there can be seen a tubing string 120 extending from the platform 10 and into the wellbore 110. The tubing string 120 can include any number of oilfield tubulars connected end-to-end in series. As used herein, the term "oilfield tubular" refers to any structure used to flow a fluid therein (e.g., a drilling fluid, a frac fluid, a production fluid), either in a main wellbore (e.g., a vertically oriented wellbore or section of wellbore) or in a slanted or lateral branch (a horizontally oriented section of a wellbore). Tubular segments may vary with regard to material, thickness, inner diameter, outer diameter, grade, and/or end connectors, and various tubular segment types are known in the industry. Tubular segments are often joined or coupled together to form a "string" (e.g., the tubing string 120) that performs a function in the wellbore 110. While some strings can hang from the earth's surface 102 or a surface on the platform 10, other strings can hang from another tubular or tubular string within the depths of the wellbore 110. An annulus 112 is formed between the inner wall 111 (or casing) of the wellbore 110 and an outer surface 122 of each oilfield tubular 121.

FIG. 1 illustrates, for exemplary purposes, swellable metal assemblies 130 and 140. Swellable metal assembly 130 can have a packer configuration (e.g., a swellable packer) as disclosed herein and can be placed around at least a portion of an oilfield tubular 123 of the tubing string 120. Swellable metal assembly 140 can have a plug configuration (e.g., a swellable plug) as disclosed herein and can be placed in an interior of the oilfield tubular 123. The swellable metal assembly 130 and swellable metal assembly 140 are shown in combination with the same oilfield tubular 123 for illustrative purposes only, and the disclosure is not limited swellable metal assemblies 130 and 140 being used on the same oilfield tubular 123 and is not limited to the swellable metal assemblies 130 and 140 being used together.

It is contemplated that the disclosed swellable metal assemblies 130 and 140 can be used in a variety of applications, such as cementing a casing into a portion of the wellbore 110, fracturing a portion of the subterranean formation 101 adjacent a portion of the wellbore 110, and producing formation fluids (e.g., oil and gas) from the subterranean formation 101. The introduction of fluids into and withdrawing fluids from the wellbore 110 (e.g., introduction of fluid into the tubing string 120 or into the annulus; withdrawal of fluid from the tubing string 120 or annulus 112) can be accomplished according to any technique known in the art, such as by pumping fluids down the interior of the oilfield tubulars in tubing string 120 and then upward through the annulus 112, pumping fluids down the annulus 112 and then upward through the interior of the oilfield tubulars (e.g., reverse circulation techniques), receiving fluids into one or more oilfield tubulars from the subterranean formation (e.g., via holes, screens or perforations in the oilfield tubular(s)), or pumping one or more fluids downward through the oilfield tubulars and into the subterranean formation 101 (e.g., fracturing).

Swellable metal assembly 130 or 140 may be allowed to swell and form an adequate seal in the annulus 112 or inside an oilfield tubular (e.g., tubular 123) of the tubular string 120 before some applications and after other applications. For example, the swellable metal assembly 130 having a packer configuration can be allowed to swell and seal the annulus 112 between an oilfield tubular (e.g., oilfield tubular 123) and the inner wall 111 or casing of the wellbore 110 before introducing a fracturing fluid into the subterranean formation 101 via the tubing string 120, so that fracturing fluid does not flow upward through the wellbore 110 via the annulus 112. The swellable metal assembly 130 can additionally function to isolate the production zone where the fracture is formed from another producing zone or a non-producing zone. In another example, the swellable metal assembly 140 having a plug configuration may be allowed to swell and seal the interior of an oilfield tubular 123 near end 124 of the tubing string 120 before pumping cement into the annulus 112, so that cement does not flow within the interior of the tubing string 120. The swellable metal assembly 140 can then be removed by pumping a fluid under suitable pressure down the interior of the oilfield tubulars of the tubing string 120 so as to apply a removal force to the swellable metal assembly 140.

FIGS. 2A-2D, 3A-3B, 4A-4C, and 5A-5B illustrate embodiments of the swellable metal assemblies disclosed herein. The swellable metal assemblies disclosed herein are located around (packer configuration) or inside (plug configuration) an oilfield tubular, and have a reactive metal and a polymer that is in contact with at least a portion of the reactive metal. The swellable metal assemblies in combination with the oilfield tubular are referred to herein as swellable metal systems.

The reactive metal used in the swellable metal assemblies disclosed herein is configured to react with a wellbore fluid to form a metal hydroxide in-situ of a wellbore. The reactive metal(s) for use in any of the disclosed embodiments can be any metal or metal alloy that may undergo a hydration reaction to form a metal hydroxide of greater volume than the base metal or metal alloy reactant. Examples of a reactive metal include magnesium, an alloy of magnesium, calcium, an alloy of calcium, aluminum, an alloy of aluminum, tin, an alloy of tin, zinc, an alloy of zinc, beryllium, an alloy of beryllium, barium, an alloy of barium, manganese, an alloy of manganese, or any combination thereof. Preferred reactive metals include magnesium, an alloy of magnesium, calcium, an alloy of calcium, aluminum, an alloy of aluminum, or any combination thereof. Specific reactive metal alloys include magnesium-zinc, magnesium-aluminum, calcium-magnesium, and aluminum-copper. In one application, the reactive metal is a magnesium alloy including magnesium alloys that are alloyed with Al, Zn, Mn, Zr, Y, Nd, Gd, Ag, Ca, Sn, RE, or combinations thereof. In some applications, the alloy is further alloyed with a dopant that promotes galvanic reaction, such as Ni, Fe, Cu, Co, Ir, Au, Pd, or combinations thereof.

In embodiments where the reactive metal(s) is or includes a metal alloy, the metal alloy may be produced from a solid solution process or a powder metallurgical process. The metal alloy may be formed either from the metal alloy production process or through subsequent processing of the metal alloy.

As used herein, the term "solid solution" refers to an alloy that is formed from a single melt where all of the components in the alloy (e.g., a magnesium alloy) are melted together in a casting. The casting can be subsequently extruded, wrought, hipped, or worked to form the desired shape for the reactive metal(s). Preferably, the alloying components are uniformly distributed throughout the metal alloy, although intra-granular inclusions may be present, without departing from the scope of the present disclosure.

It is to be understood that some minor variations in the distribution of the alloying particles can occur, but it is preferred that the distribution is such that a homogeneous solid solution of the metal alloy is produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase.

A powder metallurgy process generally obtains or produces a fusible alloy matrix in a powdered form. The powdered fusible alloy matrix is then placed in a mold or blended with at least one other type of particle and then placed into a mold. Pressure is applied to the mold to compact the powder particles together, fusing them to form a solid material which may be used as the reactive metal particles or solid layer of reactive metal.

In some embodiments, the reactive metal(s) is or includes a metal oxide. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof. The metal oxides can also react with water to form a metal hydroxide having a volume greater than the volume of the metal oxide. As an example, calcium oxide reacts with water in an energetic reaction to produce calcium hydroxide. 1 mole of calcium oxide occupies 9.5 $cm^3$; whereas, 1 mole of calcium hydroxide occupies 34.4 $cm^3$, which is a 260% volumetric expansion.

In embodiments, the reactive metal(s) does not degrade (e.g., is water-insoluble) in a wellbore fluid that is or includes a brine. For example, magnesium hydroxide and calcium hydroxide have low solubility in water.

As discussed above, the reactive metal(s) disclosed herein react by undergoing metal hydration reactions in the presence of water contained in a wellbore fluid (e.g., brines) to form metal hydroxides. These reactions are exothermic (generate heat), and the heat generated by the reaction of the reactive metal with water in a wellbore fluid is referred to herein as the heat of reaction. A metal hydroxide particle occupies more space than the base reactive metal particle. This change in volume allows the reactive metal hydroxide particles to fill cracks, gaps, and micro-annuli that can form i) in a disclosed cement composition placed in an annulus 112 between the inner wall 111 of the wellbore 110 and an outer surface 109 of the oilfield tubular 108, ii) in the subterranean formation 106 and extend to the inner wall 111 of the wellbore 110, or iii) in the oilfield tubular 108. For example, a mole of magnesium has a molar mass of 24 g/mol and a density of 1.74 g/$cm^3$ which results in a volume of 13.8 $cm^3$/mol. Magnesium hydroxide has a molar mass of 60 g/mol and a density of 2.34 g/$cm^3$ which results in a volume of 25.6 $cm^3$/mol. 25.6 $cm^3$/mol is 85% more volume than 13.8 $cm^3$/mol. As another example, a mole of calcium has a molar mass of 40 g/mol and a density of 1.54 g/$cm^3$ which results in a volume of 26.0 $cm^3$/mol. Calcium hydroxide has a molar mass of 76 g/mol and a density of 2.21 g/$cm^3$ which results in a volume of 34.4 $cm^3$/mol. 34.4 $cm^3$/mol is 32% more volume than 26.0 $cm^3$/mol. As yet another example, a mole of aluminum has a molar mass of 27 g/mol and a density of 2.7 g/$cm^3$ which results in a volume of 10.0 $cm^3$/mol. Aluminum hydroxide has a molar mass of 63 g/mol and a density of 2.42 g/$cm^3$ which results in a volume of 26 $cm^3$/mol. 26 $cm^3$/mol is 160% more volume than 10 $cm^3$/mol.

In embodiments, the volume of the annulus 112 in which the reactive metal(s) is disposed is less than the volume of the metal hydroxide particles that could potentially be formed by reaction of the reactive metal atoms or particles with a wellbore fluid. In some examples, the volume of the annulus 112 is less than as much as 50% of the metal hydroxide particle volume. Additionally or alternatively, the volume of the annulus 112 in which the reactive metal atoms/particles are be disposed may be less than 90%, less than 80%, less than 70%, or less than 60% of the metal hydroxide particle volume.

In embodiments, the volume of the interior of the oilfield tubular 123 in which the reactive metal(s) is disposed is less than the volume of the metal hydroxide particles that could potentially be formed by reaction of the reactive metal atoms or particles with a wellbore fluid. In some examples, the volume of the interior is less than as much as 50% of the metal hydroxide particle volume. Additionally or alternatively, the volume of the interior in which the reactive metal atoms/particles are be disposed may be less than 90%, less than 80%, less than 70%, or less than 60% of the metal hydroxide particle volume.

In some embodiments, the metal hydroxide formed from the reactive metal(s) may be dehydrated under sufficient pressure. For example, if the metal hydroxide resists movement from additional hydroxide formation, elevated pressure may be created which may dehydrate some of the metal hydroxide particles to form a reactive metal oxide or the reactive metal. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. In some embodiments, the dehydration of the metal hydroxide to the reactive metal may allow the reactive metal to again react to form a metal hydroxide (i.e., the dehydration is reversible once pressure is relieved and in the presence of water).

In aspects, the polymer has a phase change temperature such that the polymer is configured to phase change upon exposure to a heat of reaction of the reactive metal with a wellbore fluid, or upon discontinuance of the heat of reaction. "Phase change" as disclosed herein can include a change in the phase or state of the polymer, a change in a physical attribute of the polymer, or both a change in the phase or state and a physical attribute. Phase change can include changing from a solid polymer to a softened polymer, from a softened polymer to a liquid polymer, from a liquid polymer to a softened polymer, from a softened polymer to a solid polymer, or any combination thereof. Physical attributes can include vulcanization and crystallization. In aspects, one or more of the physical attributes can occur before, during, or after a phase change, such as vulcanization of the polymer crystallization of the polymer, or both.

The phase change temperature can include a softening temperature, a melting temperature, or both the softening temperature and the melting temperature.

In aspects, the polymer has a softening temperature such that the polymer is configured to soften upon exposure to a heat of reaction of the reactive metal with a wellbore fluid. In some aspects, the polymer can soften, but not melt, upon exposure to the heat of reaction, e.g., phase change from a solid polymer to a softened polymer. In other aspects, the polymer can soften and then melt upon exposure to the heat of reaction, e.g., phase change from a solid polymer to a softened polymer, and then from the softened polymer to a liquid polymer. In aspects where the polymer melts, upon discontinuance of heat of reaction, the polymer can phase change from a liquid polymer to a softened polymer, and as the polymer continues to cool, from the softened polymer can phase change to a solid polymer. In aspects where the polymer does not melt, upon discontinuance of heat of reaction, the polymer can phase change from a softened polymer to a solid polymer. In some aspects, the polymer may be a softened polymer under downhole conditions and phase change between the softened polymer and liquid polymer only.

The softening temperature of the polymer can be greater than a downhole temperature. The term "softening temperature" as used herein refers to a temperature or a range of temperatures at which the polymer of a swellable metal assembly disclosed herein forms a softened polymer. The softening temperature can include any temperature or range of temperatures between the first temperature at which the polymer begins to soften and a second temperature at which the polymer begins to melt. The softening temperature can also include any temperature or range of temperatures in the glass transition temperature, Tg. Temperature values associated with the softening temperature can be measured according to ASTM D1525-17e1 or ISO 306 (for softening temperatures), ASTM E1545-11 or ISO 11359-2 (for glass transition temperatures by thermomechanical analysis), ASTM E1356-08 or ISO 11357-2 (for glass transition temperatures by differential scanning calorimetry), or a combination thereof.

Temperature values associated with the melting temperature can be measured according to ASTM D3418-15 or ISO 11357-3.

The amount of polymer relative to the amount of reactive metal in the swellable metal assembly is such that the heat of reaction supplied to the polymer softens, but does not melt, the polymer. To accomplish the balance in heat of reaction with polymer softening, it is believed that the swellable metal assembly can include 1-49 vol % polymer and 51-99 vol % reactive metal.

In some aspects, the polymer can include a thermoplastic polyurethane, a thermoplastic vulcanizate, or a combination thereof. In additional or alternative aspects, the polymer can include acrylic, ABS, nylon, PLA, polybenzimidazole, polycarbonate, polyether sulfone, polyoxymethylene, polyetherether ketone, polyetherimide, polyethylene, polyphenylene oxide, polyphenylene sulfide, polypropylene, polystyrene, polyvinyl chloride, polyvidnylidene fluoride, polytetrafluoroethylene, or a combination thereof. In additional or alternative aspects, the polymer can include an uncured elastomer.

In aspects, the polymer is non-porous. In additional or alternative aspects, the polymer is inert and non-reactive with the reactive metal and the wellbore fluid.

The wellbore fluid described herein generally includes water as part of the fluid composition. In some embodiments, the wellbore fluid can be a pumpable cement, a drilling fluid, a fracturing fluid, or a production fluid. In some embodiments, the wellbore fluid includes a brine. The brine may include saltwater (e.g., water containing one or more salts dissolved therein), saturated saltwater (e.g., saltwater produced from a subterranean formation), seawater, fresh water, or any combination thereof. Generally, the brine may be from any source. The brine may be a monovalent brine or a divalent brine. Suitable monovalent brines may include, for example, sodium chloride brines, sodium bromide brines, potassium chloride brines, potassium bromide brines, and the like. Suitable divalent brines can include, for example, magnesium chloride brines, calcium chloride brines, calcium bromide brines, and the like. In some examples, the salinity of the brine may exceed 10%. In said examples, use of elastomeric binder materials may be impacted. Advantageously, the reactive metal(s) of the present disclosure is not impacted by contact with high-salinity brines.

FIGS. 2A to 2D illustrate cross-sectional views of swellable metal assemblies 200, 201, 202, and 203 in a first configuration that is before swelling or expansion of reactive metal due to contact with a wellbore fluid in the wellbore or casing 210. The assemblies 200, 201, 202, and 203 each have a packer configuration. Each of assemblies 200, 201, 202, and 203 has a reactive metal in the shape of an annular sleeve 230. The annular sleeve 230 fits around and contacts the outer surface 224 of the oilfield tubular 223, and the reactive metal is a solid piece of the reactive metal that is formed in the shape of tubular structure. The solid piece of the reactive metal can be one or a combination of the species of reactive metal disclosed herein. The polymer of each assembly 200, 201, 202, and 203 is embodied as one or more polymer rings, which is described in more detail for each of FIGS. 2A to 2D below. The polymer in each assembly 200, 201, 202, and 203 can be one or a combination of species of the polymer disclosed herein.

Figure 2A:
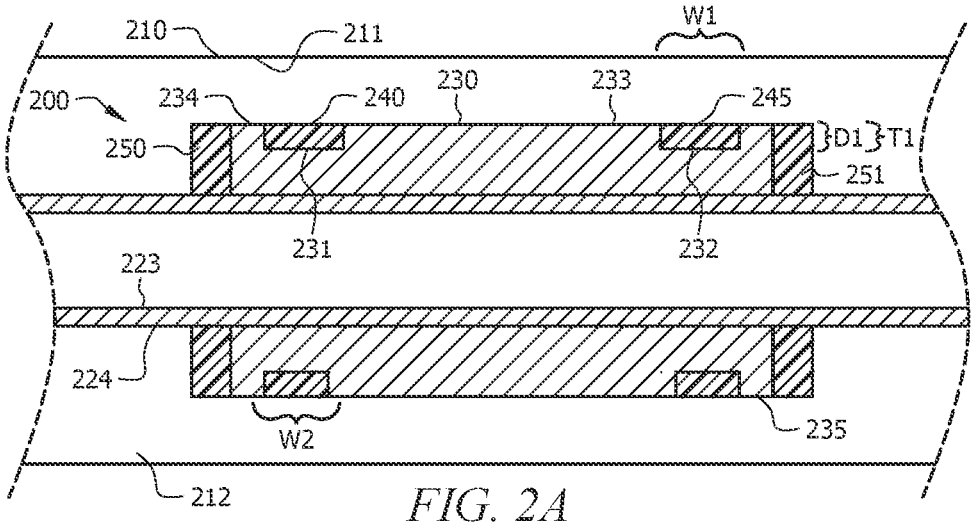
FIGS. 2A to 2D illustrate cross-sectional views of swellable metal assemblies in a first configuration.

The swellable metal assembly 200 in FIG. 2A has grooves 231 and 232 formed in an outer surface 233 of the annular sleeve 230. The grooves 231 and 232 extend around the circumference of the annular sleeve 230 and can be of any dimensions (e.g., depth, width, and shape) so as to hold the polymer therein. For example, the depth D1 of each groove 231 and 232 can be 0.25, 0.5, 0.75, or 1 inch (6.35, 12.7, 19.05, or 25.4 mm), and the width W1 of each groove 231 and 232 can be about 1, 1.5, 2, 2.5, 3, 3.5, 4, 4.5, or 5 inches (about 2.54, 3.81, 5.08, 6.35, 7.62, 8.89, 10.16, 11.43, 12.7 cm). The polymer in swellable metal assembly 200 can be embodied as rings 240 and 245. Polymer ring 240 can be placed in groove 231, and polymer ring 245 can be placed in groove 232. The thickness T1 of each polymer ring 240 and 245 can be 0.25, 0.5, 0.75, or 1 inch (6.35, 12.7, 19.05, or 25.4 mm), and in the swellable metal assembly 200 of FIG. 2A, the depth D1 of the grooves 231 and 232 is the same as the thickness T1 of the polymer rings 240 and 245. The width W2 of the polymer rings 240 and 245 can be equal to or less than the width W1 of the grooves 231 and 232. For example, the width W2 of each polymer ring 240 and 241 can be about 1, 1.5, 2, 2.5, 3, 3.5, 4, 4.5, or 5 inches (about 2.54, 3.81, 5.08, 6.35, 7.62, 8.89, 10.16, 11.43, 12.7 cm).

While two grooves 231 and 232 and two polymer rings 240 and 245 are illustrated in FIG. 2A, it is contemplated that the swellable metal assembly 200 of FIG. 2A can have one groove 231 or 232 and one polymer ring 240 or 245, or more than two grooves 231 and 232 and more than two polymer rings 240 and 245.

FIG. 2A also shows the swellable metal assembly 200 with endcaps 250 and 251. 234 235 Endcaps 250 and 251 can protect the reactive metal on ends 234 and 235 of the annular sleeve 230 from contact with corrosive materials during installation and while in place in the wellbore or casing 210. Additionally, endcaps 250 and 251 can urge the expansion of the annular sleeve 230 radially outwardly from the oilfield tubular 223. Endcaps 250 and 251 can also create a barrier that prevents any applied pressure in the annulus 212 of the wellbore or casing 210 against the swellable metal assembly 200 from compromising the seal formed by the swellable metal assembly 200 (after expansion and sealing)

in the direction of the applied pressure. The endcaps 250 and 251 can be formed of polymer, e.g., the same species of polymer as polymer rings 240 and 245 or a different species.

It is to be understood that endcaps 250 and 251 can be used with any swellable metal assembly disclosed herein, and the illustration of endcaps 250 and 251 in combination with swellable metal assembly 200 is for descriptive purposes. It should also be understood that endcaps 250 and 251 are optional components in all examples described herein.

Figure 2B:
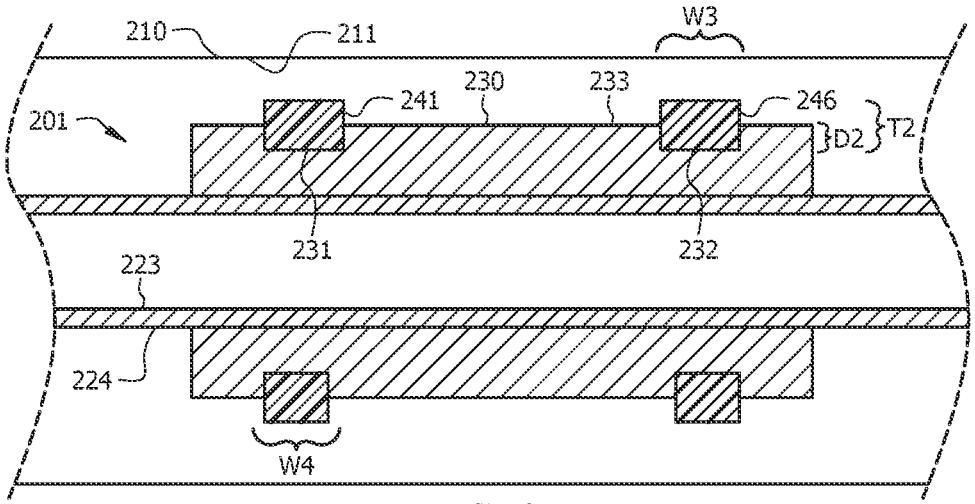

The swellable metal assembly 201 in FIG. 2B has grooves 231 and 232 formed in an outer surface 233 of the annular sleeve 230. The grooves 231 and 232 extend around the circumference of the annular sleeve 230 and can be of any dimensions (e.g., depth, width, and shape) so as to hold the polymer therein. For example, the depth D2 of each groove 231 and 232 can be 0.25, 0.5, 0.75, or 1 inch (6.35, 12.7, 19.05, or 25.4 mm), and the width W3 of each groove 231 and 232 can be about 1, 1.5, 2, 2.5, 3, 3.5, 4, 4.5, or 5 inches (about 2.54, 3.81, 5.08, 6.35, 7.62, 8.89, 10.16, 11.43, 12.7 cm). The polymer in swellable metal assembly 201 can be embodied as rings 241 and 246. Polymer ring 241 can be placed in groove 231, and polymer ring 246 can be placed in groove 232. The thickness T2 of each polymer ring 241 and 246 can be 0.25, 0.5, 0.75, or 1 inch (6.35, 12.7, 19.05, or 25.4 mm), and in the swellable metal assembly 201 of FIG. 2B, the depth D2 of the grooves 231 and 232 is less than the thickness T2 of the polymer rings 241 and 246. Thus, the polymer rings 241 and 246 extend radially outwardly beyond the outer surface 233 of the annular sleeve 230 of reactive metal in assembly 201 of FIG. 2B. The width W4 of the polymer rings 241 and 246 can be equal to or less than the width W3 of the grooves 231 and 232. For example, the width W4 of each polymer ring 241 and 246 can be about 1, 1.5, 2, 2.5, 3, 3.5, 4, 4.5, or 5 inches (about 2.54, 3.81, 5.08, 6.35, 7.62, 8.89, 10.16, 11.43, 12.7 cm).

While two grooves 231 and 232 and two polymer rings 241 and 246 are illustrated in FIG. 2B, it is contemplated that the swellable metal assembly 201 of FIG. 2B can have one groove 231 or 232 and one polymer ring 241 or 246, or more than two grooves 231 and 232 and more than two polymer rings 241 and 246. In aspects, the swellable metal assembly 201 of FIG. 2B can optionally include the endcaps 250 and 251 of FIG. 2A.

Figure 2C:
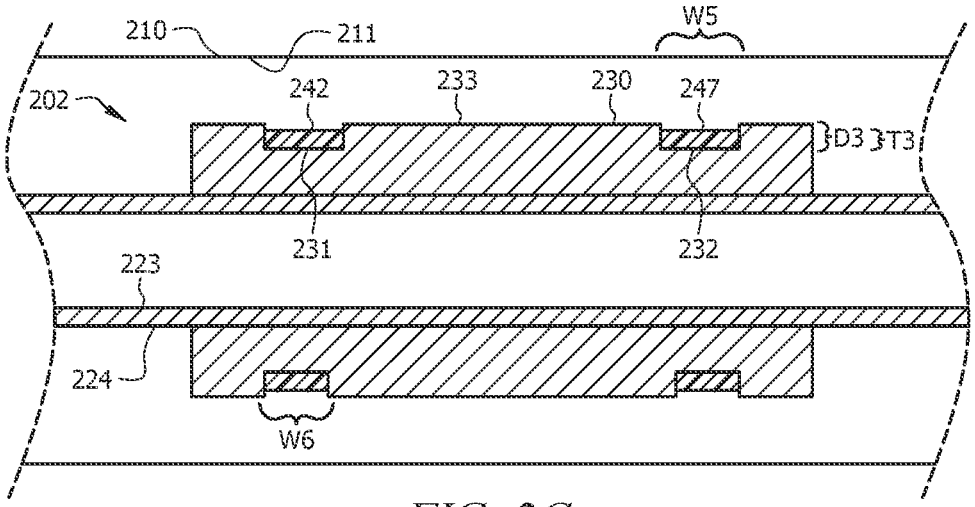

The swellable metal assembly 202 in FIG. 2C has grooves 231 and 232 formed in an outer surface 233 of the annular sleeve 230. The grooves 231 and 232 extend around the circumference of the annular sleeve 230 and can be of any dimensions (e.g., depth, width, and shape) so as to hold the polymer therein. For example, the depth D3 of each groove 231 and 232 can be 0.25, 0.5, 0.75, or 1 inch (6.35, 12.7, 19.05, or 25.4 mm), and the width W5 of each groove 231 and 232 can be about 1, 1.5, 2, 2.5, 3, 3.5, 4, 4.5, or 5 inches (about 2.54, 3.81, 5.08, 6.35, 7.62, 8.89, 10.16, 11.43, 12.7 cm). The polymer in swellable metal assembly 202 can be embodied as rings 242 and 247. Polymer ring 242 can be placed in groove 231, and polymer ring 247 can be placed in groove 232. The thickness T3 of each polymer ring 242 and 247 can be 0.25, 0.5, 0.75, or 1 inch (6.35, 12.7, 19.05, or 25.4 mm), and in the swellable metal assembly 202 of FIG. 2C, the depth D3 of the grooves 231 and 232 is greater than the thickness T3 of the polymer rings 241 and 246. Thus, the polymer rings 242 and 247 extend radially outwardly but do not protrude in a radial direction beyond the outer surface 233 of the annular sleeve 230 of reactive metal in assembly 202 of FIG. 2C. The width W6 of the polymer rings 242 and 247 can be equal to or less than the width W5 of the grooves 231 and 232. For example, the width W6 of each polymer ring 242 and 247 can be about 1, 1.5, 2, 2.5, 3, 3.5, 4, 4.5, or 5 inches (about 2.54, 3.81, 5.08, 6.35, 7.62, 8.89, 10.16, 11.43, 12.7 cm).

While two grooves 231 and 232 and two polymer rings 242 and 247 are illustrated in FIG. 2C, it is contemplated that the swellable metal assembly 202 of FIG. 2C can have one groove 231 or 232 and one polymer ring 242 or 247, or more than two grooves 231 and 232 and more than two polymer rings 242 and 247. In aspects, the swellable metal assembly 202 of FIG. 2C can optionally include the endcaps 250 and 251 of FIG. 2A.

Figure 2D:
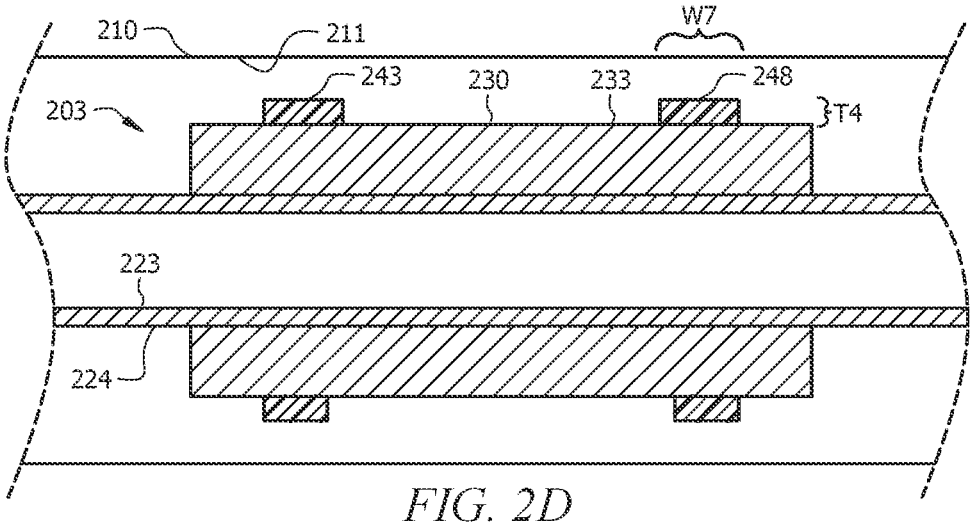

The swellable metal assembly 203 in FIG. 2D has no grooves. The polymer in swellable metal assembly 203 can be embodied as rings 243 and 248. Polymer rings 243 and 248 can be placed around the circumference of outer surface 233 of the annular sleeve 230. The thickness T4 of each polymer ring 243 and 248 can be 0.25, 0.5, 0.75, or 1 inch (6.35, 12.7, 19.05, or 25.4 mm). The width W7 of each polymer ring 243 and 248 can be about 1, 1.5, 2, 2.5, 3, 3.5, 4, 4.5, or 5 inches (about 2.54, 3.81, 5.08, 6.35, 7.62, 8.89, 10.16, 11.43, 12.7 cm).

While two polymer rings 243 and 248 are illustrated in FIG. 2D, it is contemplated that the swellable metal assembly 203 of FIG. 2D can have one polymer ring 243 or 248, or more than polymer rings 243 and 248. In aspects, the swellable metal assembly 203 of FIG. 2D can optionally include the endcaps 250 and 251 of FIG. 2A.

While the cross-section of each of the polymer rings 240-248 in FIGS. 2A to 2D is shown having a rectangular shape, the cross-section of the polymer rings 240-248 can be of any shape, such as square, circle, triangular, or any other polygonal cross-section. Likewise, while the cross-section of the grooves 231 and 232 in the annular sleeve 230 of FIGS. 2A to 2D is shown having a rectangular shape, the cross-section of the grooves 231 and 232 can be of any shape, such as square, circle, triangular, or any other polygonal cross-section.

When a wellbore fluid contacts the annular sleeve 230 in FIGS. 2A to 2D, the volume of the annular sleeve 230 increases. The heat of reaction of the reactive metal with the wellbore fluid causes the polymer rings 240-248 to phase change (e.g., soften without melting, or soften and then melt), and the polymer of the rings 240-248 decreases in thickness and width, which increases the ring diameter, as the annular sleeve 230 expands. The annular sleeve 230 can expand until the polymer rings 240-248 are in sealing engagement with the inner wall 211 of the wellbore or casing 210.

Figure 3A:
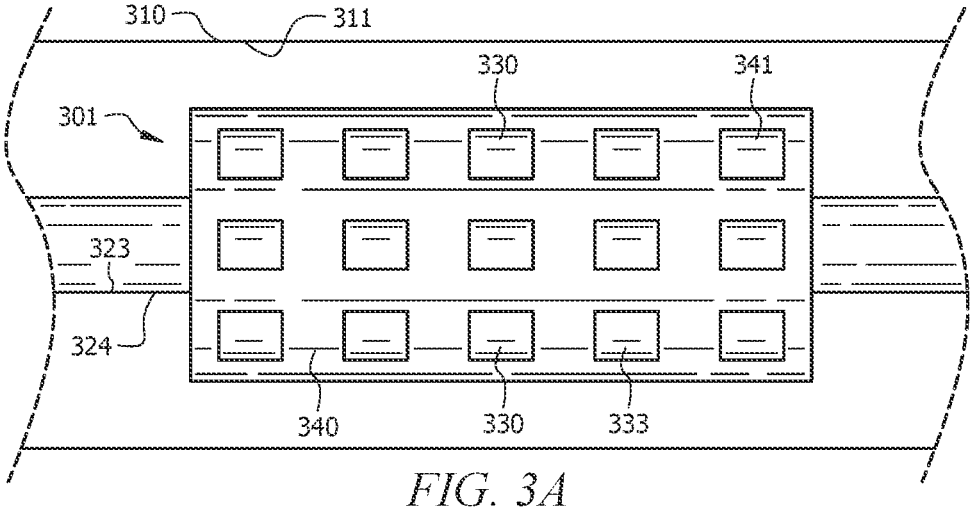
FIGS. 3A and 3B illustrate side views of swellable metal assemblies in a first configuration.
Figure 3B:
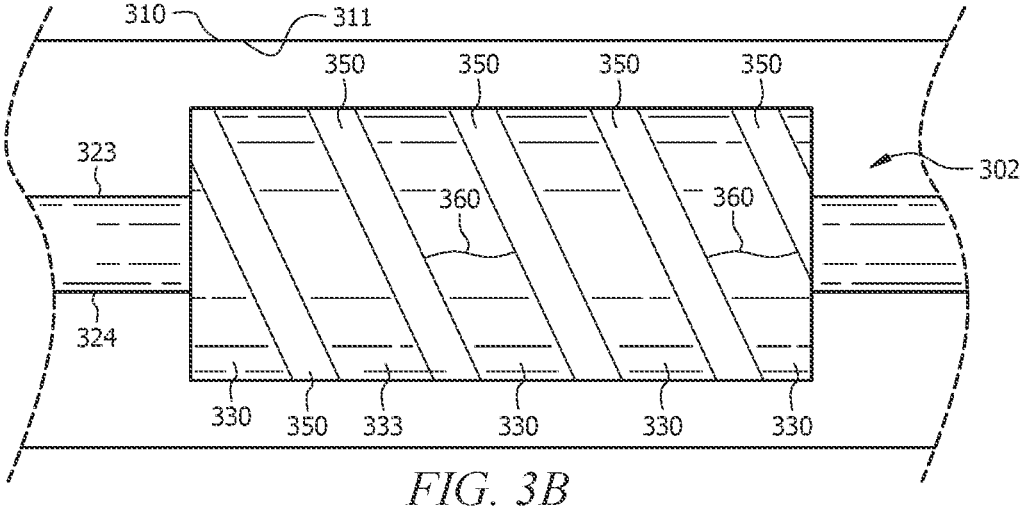

FIGS. 3A to 3B illustrate side views of swellable metal assemblies 301 and 302 in a first configuration that is before swelling or expansion of reactive metal due to contact with a wellbore fluid in the wellbore or casing 310. The assemblies 301 and 302 each have a packer configuration. Each of assemblies 301 and 302 has a reactive metal in the shape of an annular sleeve 330. The annular sleeve 330 fits around and contacts the outer surface 324 of the oilfield tubular 323, and the reactive metal is a solid piece of the reactive metal that is formed in the shape of the annular sleeve 330. The solid piece of the reactive metal can be one or a combination of the species of reactive metal disclosed herein. The polymer of assembly 301 is embodied as a sleeve 340 in FIG. 3A and as a tape 350 in FIG. 3B. The polymer in each assembly 301 and 302 can be one or a combination of species of the polymer disclosed herein.

The swellable metal assembly 301 in FIG. 3A has a polymer sleeve 340 around the outer surface 333 of the annular sleeve 330. The polymer sleeve 340 has holes 341 formed therein through which a wellbore fluid can contact the reactive metal of the annular sleeve 330. While the holes 341 are shown as having square shape, the shape of holes 341 can be any shape or combination of shapes. Moreover, the size of the holes 341 is not limited to the size shown in FIG. 3A and can be larger or smaller. Moreover still, the holes 341 can have any combination of shapes and any combination of sizes. In some embodiments, the holes 341 in the sleeve 340 are a netting or mesh configuration configured to allow wellbore fluid to contact the reactive metal through the holes 341 of the polymer sleeve 340. The polymer sleeve 340 can be installed on the outer surface 333 of the annular sleeve 330 by sliding the sleeve 340 over the annular sleeve 330. The thickness of the polymer sleeve 340 can be 0.25, 0.5, 0.75, or 1 inch (6.35, 12.7, 19.05, or 25.4 mm). In aspects, the swellable metal assembly 301 of FIG. 3A can optionally include the endcaps 250 and 251 of FIG. 2A.

When a wellbore fluid contacts annular sleeve 330 in FIG. 3A, the volume of the annular sleeve 330 increases. The heat of reaction of the reactive metal with the wellbore fluid causes the polymer sleeve 340 to phase change (e.g., soften without melting, or soften and then melt), and the polymer of the sleeve 340 can decrease in thickness and the holes 341 can increase in size, as the annular sleeve 330 expands. The annular sleeve 330 can expand until the polymer sleeve 340 is in sealing engagement with the inner wall 311 of the wellbore or casing 310.

The swellable metal assembly 303 in FIG. 3B has a polymer tape 350 around the outer surface 333 of the annular sleeve 330. The thickness of the tape 350 can be 0.25, 0.5, 0.75, or 1 inch (6.35, 12.7, 19.05, or 25.4 mm). The polymer tape 350 has adhesive on one side, and the adhesive can attach the polymer tape 350 to the outer surface 333 of the annular sleeve 3330. The tape 350 can be wrapped around the annular sleeve 330 in any pattern, such as the spiral pattern shown in FIG. 3B. In aspects, the polymer tape 350 is wrapped such that space 360 is between the wrappings of the tape 350. The space 360 exposes the outer surface 333 of the annular sleeve 330 so that the reactive metal can contact wellbore fluid. The polymer tape 350 can be installed on the outer surface 333 of the annular sleeve 330 by wrapping the tape 350 around the outer surface 333 of the annular sleeve 330. In aspects, the swellable metal assembly 302 of FIG. 3B can optionally include the endcaps 250 and 251 of FIG. 2A.

When a wellbore fluid contacts annular sleeve 330 in FIG. 3B, the volume of the annular sleeve 330 increases. The heat of reaction of the reactive metal with the wellbore fluid causes the polymer tape 350 to phase change (e.g., soften without melting, or soften and then melt), and the polymer of the tape 350 can decrease in thickness and width, and increase in diameter, as the annular sleeve 330 expands. The annular sleeve 330 can expand until the polymer tape 350 is in sealing engagement with the inner wall 311 of the wellbore or casing 310.

Figure 4A:
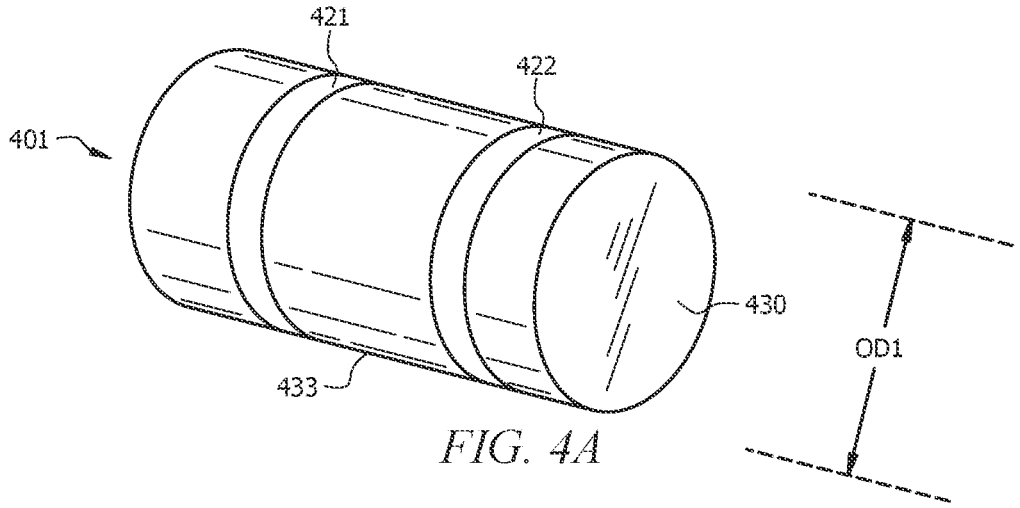
FIGS. 4A to 4C illustrate perspective views of swellable metal assemblies in a first configuration.
Figure 4B:
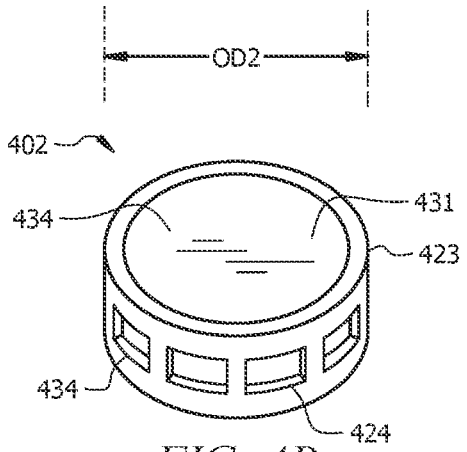
Figure 4C:
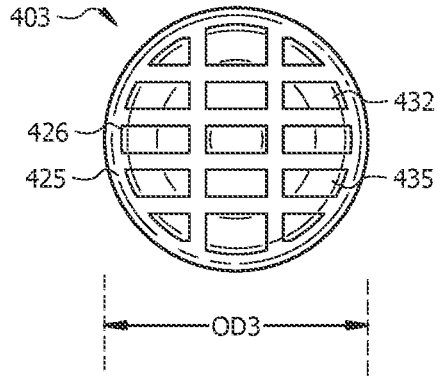

FIGS. 4A to 4C illustrate perspective views of swellable metal assemblies 401, 402, and 403 in a first configuration that is before swelling or expansion of reactive metal due to contact with a wellbore fluid inside an oilfield tubular. The assemblies 401, 402, and 403 each have a plug configuration. The outer diameters OD1, OD2, and OD3 (the total outer diameter of the reactive metal and the polymer combined) are less than the internal diameter of an oilfield tubular, for example, oilfield tubular 123 of tubing string 120 illustrated in FIG. 1, oilfield tubular 223 in FIGS. 2A to 2D, or oilfield tubular 323 in FIGS. 3A to 3B.

The swellable metal assembly 401 of FIG. 4A has a solid cylindrical body 430 of the reactive metal. The polymer is embodied as polymer rings 421 and 422, which are placed around the circumference of the outer surface 433 of the solid cylindrical body 430 similar to the placement of polymer rings 243 and 248 shown in and described for FIG. 2D. Alternatively, the polymer rings 421 and 422 may be placed in grooves formed in the cylindrical body 430, similar to the grooves 231 and 232 shown in and described form FIGS. 2A to 2C.

The thickness of each polymer ring 421 and 422 can be 0.25, 0.5, 0.75, or 1 inch (6.35, 12.7, 19.05, or 25.4 mm). The width of each polymer ring 421 and 422 can be about 1, 1.5, 2, 2.5, 3, 3.5, 4, 4.5, or 5 inches (about 2.54, 3.81, 5.08, 6.35, 7.62, 8.89, 10.16, 11.43, 12.7 cm). The depth of any groove present in assembly 401 can be 0.25, 0.5, 0.75, or 1 inch (6.35, 12.7, 19.05, or 25.4 mm), and the width of any groove present in assembly 401 can be about 1, 1.5, 2, 2.5, 3, 3.5, 4, 4.5, or 5 inches (about 2.54, 3.81, 5.08, 6.35, 7.62, 8.89, 10.16, 11.43, 12.7 cm). In aspects of assembly 401 where grooves are present, the depth of the grooves can be less than, equal to, or greater than the thickness of the polymer rings 421 and 422, and the width of the polymer rings 421 and 422 can be equal to or less than the width of the grooves.

When a wellbore fluid contacts the solid cylindrical body 430 in FIG. 4A, the volume of the body 430 increases. The heat of reaction of the reactive metal with the wellbore fluid causes the polymer rings 421 and 422 to phase change (e.g., soften without melting, or soften and then melt), and the polymer of the rings 421 and 422 decreases in thickness and width, which increases the ring diameter, as the body 430 expands. The body 430 can expand until the polymer rings 421 and 422 are in sealing engagement with the inner wall of an oilfield tubular.

The swellable metal assembly 402 of FIG. 4B has a solid cylindrical body 431 of the reactive metal. The polymer is embodied as a polymer sleeve 423 that is placed around the circumference of the outer surface 434 of the solid cylindrical body 431. The polymer sleeve 423 has holes 424 formed therein through which a wellbore fluid can contact the reactive metal of the solid cylindrical body 431. While the holes 424 are shown as having square shape, the shape of holes 424 can be any shape or combination of shapes. Moreover, the size of the holes 424 is not limited to the size shown in FIG. 4B and can be larger or smaller. Moreover still, the holes 424 can have any combination of shapes and any combination of sizes. In some embodiments, the holes 424 in the sleeve 423 are a netting or mesh configuration configured to allow wellbore fluid to contact the reactive metal through the holes 424 of the polymer sleeve 423. The polymer sleeve 423 can be installed on the outer surface 434 of the body 431 by sliding the sleeve 423 over the body 431. The thickness of the polymer sleeve 423 can be 0.25, 0.5, 0.75, or 1 inch (6.35, 12.7, 19.05, or 25.4 mm).

When a wellbore fluid contacts the solid cylindrical body 431 in FIG. 4B, the volume of the body 431 increases. The heat of reaction of the reactive metal with the wellbore fluid causes the polymer sleeve 423 to phase change (e.g., soften without melting, or soften and then melt), and the polymer of the sleeve 423 decreases in thickness and, which increases the diameter of the sleeve 423, as the body 431 expands. The body 431 can expand until the polymer sleeve 423 is in sealing engagement with the inner wall of an oilfield tubular.

The swellable metal assembly 403 of FIG. 4C has a solid spherical body 432 of the reactive metal. The polymer is embodied as a spherical polymer sleeve 425 that is placed around the outer surface 435 of the solid spherical body 432. The polymer sleeve 425 has holes 426 formed therein through which a wellbore fluid can contact the reactive metal of the solid spherical body 432. While the holes 426 are shown as having square shape, the shape of holes 426 can be any shape or combination of shapes. Moreover, the size of the holes 426 is not limited to the size shown in FIG. 4C and can be larger or smaller. Moreover still, the holes 426 can have any combination of shapes and any combination of sizes. In some embodiments, the holes 426 in the sleeve 425 are a netting or mesh configuration configured to allow wellbore fluid to contact the reactive metal through the holes 426 of the polymer sleeve 425. The thickness of the polymer sleeve 425 can be 0.25, 0.5, 0.75, or 1 inch (6.35, 12.7, 19.05, or 25.4 mm). The polymer sleeve 425 can be installed on the outer surface 435 of the body 432 by sliding the sleeve 425 over the body 432.

When a wellbore fluid contacts the solid spherical body 432 in FIG. 4C, the volume of the body 432 increases. The heat of reaction of the reactive metal with the wellbore fluid causes the polymer sleeve 425 to phase change (e.g. soften without melting, or soften and then melt), and the polymer of the sleeve 425 decreases in thickness and, which increases the diameter of the sleeve 425, as the body 432 expands. The body 432 can expand until a portion of the polymer sleeve 425 is in sealing engagement with the inner wall of an oilfield tubular.

In aspects of the assemblies 200-203, 301-302, and 401-403 illustrated in FIGS. 2A-2D, 3A-3B, and 4A-4C, the polymer (e.g., embodied as ring, sleeve, or tape) can be attached to the reactive metal with an adhesive.

Figure 5A:
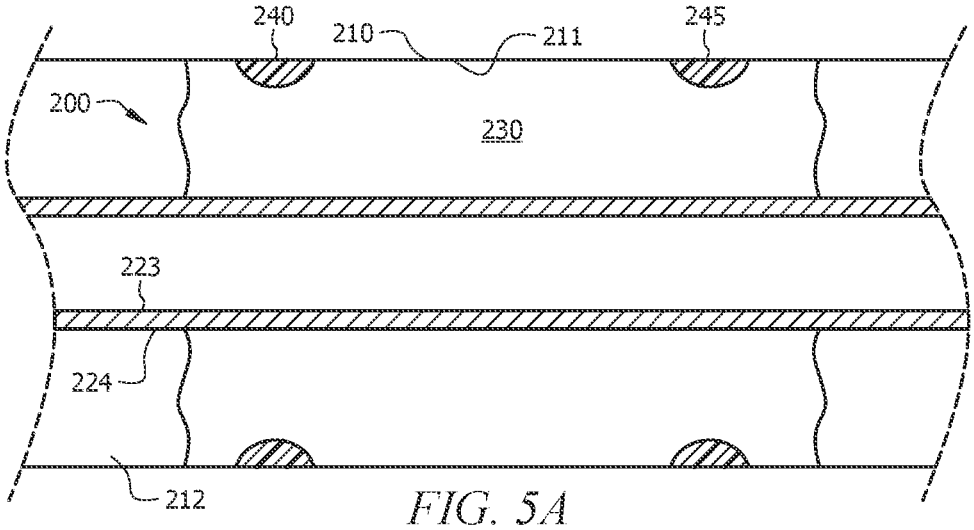
FIGS. 5A and 5B illustrate cross-sectional views of swellable metal assemblies in a second configuration

FIG. 5A shows a cross-sectional view of swellable metal assembly 200 of FIG. 2A in a second configuration that is after swelling or expansion of reactive metal due to contact with a wellbore fluid in the wellbore or casing 210. The reactive metal of the annular sleeve 230 has contacted wellbore fluid in the annulus between the inner wall 211 of the wellbore or casing 310 and the outer surface 224 of the oilfield tubular 223, and reacted thus causing the volume of the annular sleeve 230 to increase. The heat of reaction of the reactive metal with the wellbore fluid caused the polymer rings 240 and 245 to phase change (e.g. soften without melting, or soften and then melt), and the polymer of the rings 240 and 245 increased in diameter, until the rings 240 and 245 contacted the inner wall 211 of the wellbore or casing 210. The reactive metal in the annular sleeve 230 continued to react with the wellbore fluid until the polymer rings 240 and 245 as well as the reaction product of portions of the annular sleeve 230 that were not covered by the polymer rings 240 and 245, made sealing engagement with the inner wall 211 of the wellbore or casing 210. After reaction subsided, the polymer of the rings 240 and 245 cooled below the phase temperature (e.g., melting temperature, softening temperature, or both) and formed a polymer seal against the inner wall 211 of the wellbore or casing 210. The polymer seal in combination with the seal provided by the reaction product of the reactive metal provide an enhanced seal according to this disclosure. The swelling, expansion, and sealing as explained for FIG. 5A is applicable for swellable metal assemblies 201, 202, and 203 of FIGS. 2B to 2D and swellable metal assemblies 301 and 302 of FIGS. 3A and 3B.

Figure 5B:
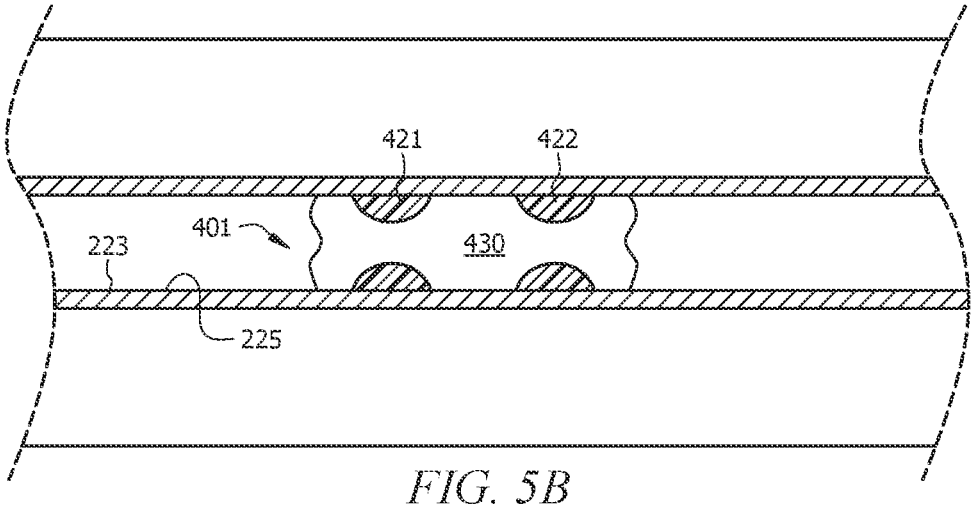

FIG. 5B shows a cross-section view of swellable metal assembly 401 configured as a plug and in a second configuration that is after swelling or expansion of reactive metal due to contact with a wellbore fluid inside an oilfield tubular 223. The reactive metal of the solid cylindrical body 430 has contacted wellbore fluid in the interior of the oilfield tubular 223, and reacted thus causing the volume of the body 430 to increase. The heat of reaction of the reactive metal with the wellbore fluid caused the polymer rings 421 and 422 to phase change (e.g. soften without melting, or soften and then melt), and the polymer of the rings 421 and 422 increased in diameter, until the rings 421 and 422 contacted the inner wall 225 of the oilfield tubular 223. The reactive metal in the body 430 continued to react with the wellbore fluid until the polymer rings 421 and 422 as well as the reaction product of portions of the body 430 that were not covered by the polymer rings 421 and 422, made sealing engagement with the inner wall 225 of the oilfield tubular 223. After reaction subsided, the polymer of the rings 421 and 422 cooled below phase change temperature (e.g., the softening temperature, the melting temperature, or both) and formed a polymer seal against the inner wall 225 of the oilfield tubular 223. The polymer seal in combination with the seal provided by the reaction product of the reactive metal provide an enhanced seal according to this disclosure. The swelling, expansion, and sealing as explained for FIG. 5B is applicable for swellable metal assemblies 402 and 403 of FIGS. 4B to 4C.

Figure 6:
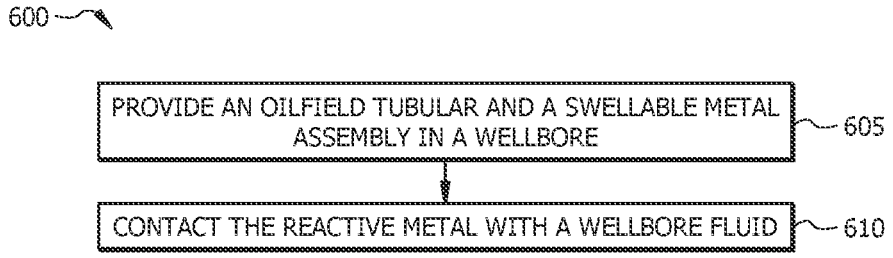
FIG. 6 illustrates a flow chart of a method according to the disclosure.

A method is described in FIG. 6 with continuing reference to FIGS. 2A to 2D, 3A to 3B, and 4A to 4C. FIG. 6 illustrates a method 600 of forming a seal in a wellbore.

At step 605, the method 600 can include providing an oilfield tubular 223 or 323 and a swellable metal assembly 200, 201, 202, 203, 301, 302, 401, 402, or 403 comprising the reactive metal and the polymer in the wellbore 210 or 310. The wellbore 210 or 310 can be lined with casing, or be open-hole (no casing). As disclosed herein, swellable metal assembly 200, 201, 202, 203, 301, 302, 401, 402, or 403 includes a reactive metal and a polymer, where the polymer is in contact with at least a portion of the reactive metal. The swellable metal assembly 200, 201, 202, 203, 301, or 302 can be located around at least a portion of the oilfield tubular 223 or 323. The swellable metal assembly 401, 402, or 403 can be located inside at least a portion of the oilfield tubular 223 or 323.

Providing the oilfield tubular 223 or 323 and the swellable metal assembly 200, 201, 202, 203, 301, or 302 can include placing the swellable metal assembly 200, 201, 202, 203, 301, or 302 on the oilfield tubular 223 or 323 and running the oilfield tubular 223 or 323 into the wellbore 210 or 310 (open hole or lined with casing). Alternatively, providing the oilfield tubular 223 or 323 and the swellable metal assembly 401, 402, or 403 can include placing the swellable metal assembly 401, 402, or 403 inside the oilfield tubular 223 or 323 and running the oilfield tubular 223 or 323 into the wellbore 210 or 310 (open hole or lined with casing).

Generally, the swellable metal assembly 200, 201, 202, 203, 301, 302, 401, 402, or 403 is provided in the wellbore 210 or 310 when swellable metal assembly 200, 201, 202, 203, 301, 302, 401, 402, or 403 is in the first configuration (e.g., before swelling or expansion due to contact with wellbore fluid).

At step 610, the method 600 can include contacting the reactive metal of the swellable metal assembly 200, 201, 202, 203, 301, 302, 401, 402, or 403 with a wellbore fluid. For example, the wellbore fluid contacts portions of the annular sleeve 230 or 330 that are not covered by polymer (e.g., between polymer rings, through the holes of a polymer sleeve, or between strands of tape). Contacting the reactive metal of swellable metal assembly 200, 201, 202, 203, 301, or 302 can include swelling the swellable metal assembly 200, 201, 202, 203, 301, or 302 (via reaction of the reactive metal with the wellbore fluid to form a reaction product having a larger volume than the unreacted reactive metal) in the annulus 212 to a second configuration to form a seal between the oilfield tubular 223 or 323 and the wellbore or casing 210 or 310. Contacting the reactive metal of swellable metal assembly 401, 402, or 403 can include swelling the assembly swellable metal assembly 401, 402, or 403 (via reaction of the reactive metal with the wellbore fluid to form a reaction product having a larger volume than the unreacted reactive metal) in the interior of the oilfield tubular 223 or 323 to a second configuration to form a seal inside the oilfield tubular 223 or 323 that is sufficient to prevent flow in the oilfield tubular 223 or 323 past the swellable metal assembly 401, 402, or 403. Generally, contacting the reactive metal of the swellable metal assembly 200, 201, 202, 203, 301, 302, 401, 402, or 403 causes the swellable metal assembly 200, 201, 202, 203, 301, 302, 401, 402, or 403 to transform from the first configuration (e.g., before contact with wellbore fluid) to the second configuration (e.g., after contact with the wellbore fluid and reaction therewith to form the reaction product).

In optional aspects, the method 600 can include removing the swellable metal assembly 200, 201, 202, 203, 301, 302, 401, 402, or 403 after a task is performed in the wellbore (e.g., surveying a zone of the wellbore, fracturing a zone of the wellbore, etc.). Removing the swellable metal assembly 200, 201, 202, 203, 301, 302, 401, 402, or 403 can include applying a pressure to the swellable metal assembly 200, 201, 202, 203, 301, 302, 401, 402, or 403 so as to convert the reaction product (e.g., metal hydroxide) back to the reactive metal, thereby decreasing the volume of the swellable metal assembly 200, 201, 202, 203, 301, 302, 401, 402, or 403 and breaking the seal that was created. Removing the swellable metal assembly 200, 201, 202, 203, 301, 302, 401, 402, or 403 may additionally include pumping, with a wellbore fluid, the removed swellable metal assembly 200, 201, 202, 203, 301, 302, 401, 402, or 403 to a desired location (e.g., to the surface or to a dead point in the wellbore 210 or 310.

Example

Figure 7:
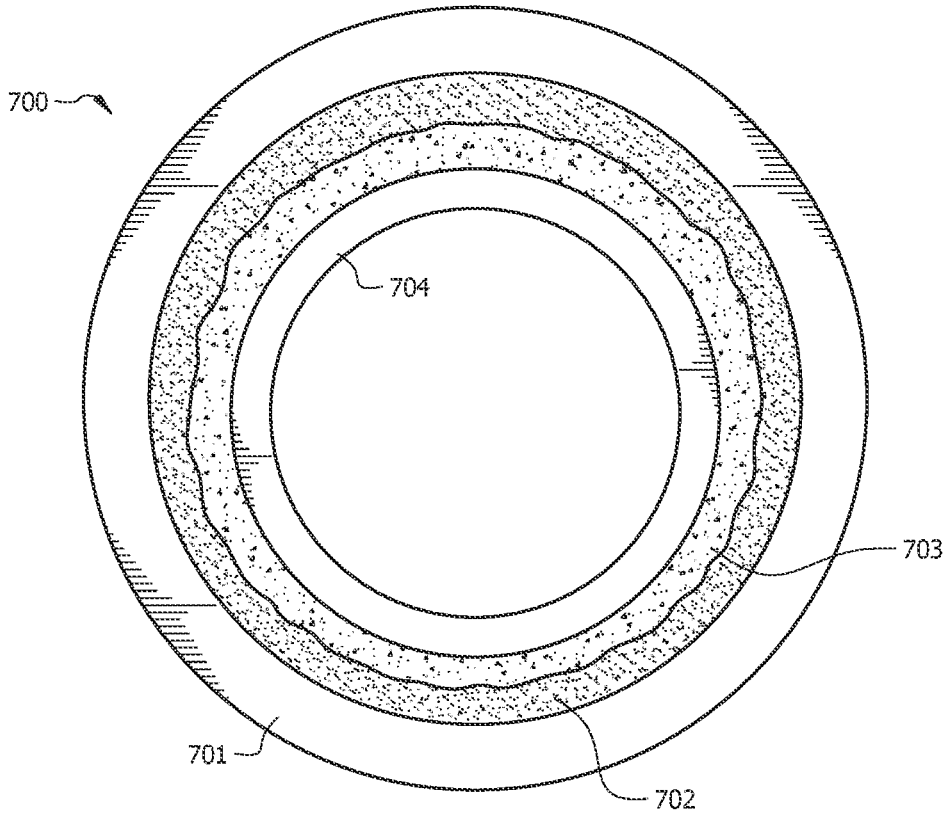
FIG. 7 illustrates a cross-section view of the swellable metal assembly and system that was obtained in Example 1.

Example 1 is described with reference to FIG. 7. FIG. 7 is a photo of a cross-section of a swellable metal assembly 700 having a packer configuration. The swellable metal assembly 700 is in the second configuration, after being placed in an outer pipe 701 that was used to simulate the inner wall of a wellbore or casing, and after contacting the reactive metal of the swellable metal assembly 700 with water while inside the outer pipe 701. As can be seen, the swellable metal assembly 700 in the second configuration has the polymer ring 702 sealed against the inner surface of the outer pipe 701, the annular sleeve 703 of the reaction product of the reactive metal is sealed between the polymer 701 and the oilfield tubular 704.

To form the swellable metal assembly 700 of Example 1, the annular sleeve 703 of reactive metal was placed around a section of the oilfield tubular 704. The oilfield tubular 704 had an outer diameter of 4.5 inches. The annular sleeve 703 had a length of 12.000 inches, an inner diameter of 4.565 inches, and an outer diameter of 5.465 inches, giving the annular sleeve 703 a thickness of 0.9 inch. A groove was formed around the circumference of the annular sleeve 703 with a depth of 0.25 inch and a width of 3.063 inches. A polymer ring 702 having a 3 inches width and 0.25 inch thickness was placed in, and glued into, the groove of the annular sleeve 703. Endcaps were placed on the ends of the annular sleeve 703. The reactive metal of Example 1 was a magnesium alloy, and the polymer of Example 1 was a thermoplastic vulcanizate known commercially as SANTOPRENE™.

The oilfield tubular 704 having the swellable metal assembly therearound was placed in the outer pipe 701 having inner diameter of 6.125 inches. Water was introduced in the annulus between the inner wall of the larger pipe 701 and the outer surface of the oilfield tubular 704 and swellable metal assembly 700. The swellable metal assembly 700 swelled from the first configuration (unexpanded) to a second configuration (expanded), with the polymer ring 702 softening and increasing in diameter as the reactive metal converted to reaction product having increased volume. The polymer ring 702 increased in diameter until contacting the inner wall of the outer pipe 701. After reactive metal reaction, the swellable metal assembly 700 cooled in the second configuration shown in FIG. 7. A differential pressure of 10,000 psi (68.9 MPa) was applied to the swellable metal assembly 700, and this differential was maintained for 48 hours, proving that the enhanced seal made by the combination of reactive metal and polymer in a swellable metal assembly 700 was effective for sealing in a wellbore environment.

Additional Disclosure

The following are non-limiting, specific embodiments in accordance with the present disclosure:

A first embodiment, which is a method for forming a seal in a wellbore comprising providing an oilfield tubular and a swellable metal assembly in the wellbore, wherein the swellable metal assembly is located around or inside at least a portion of the oilfield tubular, wherein the swellable metal assembly comprises a reactive metal and a polymer, wherein the polymer is in contact with at least a portion of the reactive metal.

A second embodiment, which is the method of the first embodiment, wherein the reactive metal is configured to react with a wellbore fluid to form a metal hydroxide in-situ of the wellbore, and wherein the polymer has a phase change temperature such that the polymer is configured to phase change upon exposure to a heat of reaction of the reactive metal with the wellbore fluid.

A third embodiment, which is the method of the second embodiment, wherein the phase change temperature of the polymer is greater than a downhole temperature.

A fourth embodiment, which is the method of any of the first through the third embodiments, wherein the reactive metal is selected from magnesium, a magnesium alloy, calcium, a calcium alloy, aluminum, an aluminum alloy, or a combination thereof.

A fifth embodiment, which is the method of any of the first through the fourth embodiments, wherein the polymer comprises a thermoplastic polyurethane, a thermoplastic vulcanizate, or a combination thereof.

A sixth embodiment, which is the method of any of the first through the fifth embodiments, wherein the polymer comprises acrylic, ABS, nylon, PLA, polybenzimidazole, polycarbonate, polyether sulfone, polyoxymethylene, polyetherether ketone, polyetherimide, polyethylene, polyphenylene oxide, polyphenylene sulfide, polypropylene, polystyrene, polyvinyl chloride, polyvidnylidene fluoride, polytetrafluoroethylene, or a combination thereof.

A seventh embodiment, which is the method of any of the first through the sixth embodiments, wherein the polymer comprises an uncured elastomer.

An eighth embodiment, which is the method of any of the first through the seventh embodiments, wherein the reactive metal is an annular sleeve configured such that an inner surface of the reactive metal faces an outer surface of the oilfield tubular, and wherein the polymer i) is a polymer ring located in a groove of the annular sleeve, ii) is an endcap placed on an end of the annular sleeve, iii) is a polymer sleeve having holes formed therein, wherein the polymer sleeve is placed around the annular sleeve, or iv) is a tape applied to the annular sleeve.

A ninth embodiment, which is the method of any of the first through the eighth embodiments, further comprising contacting the reactive metal with a wellbore fluid.

A tenth embodiment, which is a swellable metal assembly for an oilfield tubular, comprising a reactive metal configured for placement around or inside the oilfield tubular, and a polymer in contact with at least a portion of the reactive metal, wherein the polymer has a phase change temperature such that the polymer is configured to phase change upon exposure to a heat of reaction of the reactive metal with a wellbore fluid.

An eleventh embodiment, which is the swellable metal assembly of the tenth embodiment, wherein the reactive metal is configured to react with a wellbore fluid to form a metal hydroxide in-situ of a wellbore.

A twelfth embodiment, which is the swellable metal assembly of the eleventh embodiment, wherein the phase change temperature of the polymer is greater than a downhole temperature.

A thirteenth embodiment, which is the swellable metal assembly of any of the tenth through the twelfth embodiments, wherein the reactive metal is selected from magnesium, a magnesium alloy, calcium, a calcium alloy, aluminum, an aluminum alloy, or a combination thereof.

A fourteenth embodiment, which is the swellable metal assembly of any of the tenth through the thirteenth embodiments, wherein the polymer comprises a thermoplastic polyurethane, a thermoplastic vulcanizate, or a combination thereof.

A fifteenth embodiment, which is the swellable metal assembly of any of the tenth through the fourteenth embodiments, wherein the polymer comprises acrylic, ABS, nylon, PLA, polybenzimidazole, polycarbonate, polyether sulfone, polyoxymethylene, polyetherether ketone, polyetherimide, polyethylene, polyphenylene oxide, polyphenylene sulfide, polypropylene, polystyrene, polyvinyl chloride, polyvidnylidene fluoride, polytetrafluoroethylene, or a combination thereof.

A sixteenth embodiment, which is the swellable metal assembly of any of the tenth through the fifteenth embodiments, wherein the polymer comprises an uncured elastomer.

A seventeenth embodiment, which is the swellable metal assembly of any of the tenth through the sixteenth embodiments, wherein the reactive metal is an annular sleeve configured such that an inner surface of the reactive metal faces an outer surface of the oilfield tubular, and wherein the polymer i) is a polymer ring located in a groove of the annular sleeve, ii) is an endcap placed on an end of the annular sleeve, iii) is a polymer sleeve having holes formed therein, wherein the polymer sleeve is placed around the annular sleeve, or iv) is a tape applied to the annular sleeve.

An eighteenth embodiment, which is the swellable metal assembly of any of the tenth through the seventeenth embodiments, wherein the reactive metal is a cylindrical or spherical solid body having an outer diameter that is less than an inner diameter of the oilfield tubular.

A nineteenth embodiment, which is a swellable metal system for use in a wellbore, comprising an oilfield tubular, and a swellable metal assembly placed around or inside the oilfield tubular, wherein the swellable metal assembly comprises a reactive metal, and a polymer in contact with at least a portion of the reactive metal.

A twentieth embodiment, which is the swellable metal system of the nineteenth embodiment, wherein the reactive metal is configured to react with a wellbore fluid to form a metal hydroxide in-situ of the wellbore, and wherein the polymer has a phase change temperature such that the polymer is configured to phase change upon exposure to a heat of reaction of the reactive metal with the wellbore fluid.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element may be present in some embodiments and not present in other embodiments. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of this disclosure. Thus, the claims are a further description and are an addition to the embodiments of this disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method for forming a seal in a wellbore comprising:

providing an oilfield tubular and a swellable metal assembly in the wellbore, wherein the swellable metal assembly is located around or inside at least a portion of the oilfield tubular, wherein the swellable metal assembly comprises a reactive metal and a polymer, wherein the polymer is in contact with at least a portion of the reactive metal;

urging, by the reactive metal, the polymer into contact with an inner wall of the wellbore or inside the oilfield tubular in response to the reactive metal reacting with a wellbore fluid, wherein the reactive metal is configured to react with a wellbore fluid to form a metal hydroxide in-situ of the wellbore, and wherein the polymer has a phase change temperature such that the polymer is configured to phase change upon exposure to a heat of reaction of the reactive metal with the wellbore fluid and wherein the phase change temperature of the polymer to transition from a solid polymer to a softened polymer or a liquid polymer is greater than a downhole temperature.

2. The method of claim 1, wherein the reactive metal is configured to react with a wellbore fluid to form a metal hydroxide in-situ of the wellbore, and wherein the polymer has a phase change temperature such that the polymer is configured to phase change upon exposure to a heat of reaction of the reactive metal with the wellbore fluid.

3. The method of claim 1, wherein the reactive metal is selected from magnesium, a magnesium alloy, calcium, a calcium alloy, aluminum, an aluminum alloy, or a combination thereof.

4. The method of claim 1, wherein the polymer comprises a thermoplastic polyurethane, a thermoplastic vulcanizate, or a combination thereof.

5. The method of claim 1, wherein the polymer comprises acrylic, ABS, nylon, PLA, polybenzimidazole, polycarbonate, polyether sulfone, polyoxymethylene, polyetherether ketone, polyetherimide, polyethylene, polyphenylene oxide, polyphenylene sulfide, polypropylene, polystyrene, polyvinyl chloride, polyvidnylidene fluoride, polytetrafluoroethylene, or a combination thereof.

6. The method of claim 1, wherein the polymer comprises an uncured elastomer.

7. The method of claim 1, wherein the reactive metal is an annular sleeve configured such that an inner surface of the reactive metal faces an outer surface of the oilfield tubular, and wherein the polymer i) is a polymer ring located in a groove of the annular sleeve, ii) is an endcap placed on an end of the annular sleeve, iii) is a polymer sleeve having holes formed therein, wherein the polymer sleeve is placed around the annular sleeve, or iv) is a tape applied to the annular sleeve.

8. The method of claim 1, further comprising:

contacting the reactive metal with a wellbore fluid.

9. A swellable metal assembly for an oilfield tubular, comprising:

a reactive metal configured for placement around or inside the oilfield tubular; and a polymer in contact with at least a portion of the reactive metal, wherein the polymer has a phase change temperature such that the polymer is configured to phase change upon exposure to a heat of reaction of the reactive metal with a wellbore fluid;

wherein the swellable metal assembly contacts an inner wall of the wellbore or inside the oilfield tubular in response to the reactive metal reacting with the wellbore fluid.

10. The swellable metal assembly of claim 9, wherein the reactive metal is configured to react with a wellbore fluid to form a metal hydroxide in-situ of a wellbore.

11. The swellable metal assembly of claim 10, wherein the phase change temperature of the polymer to transition from a solid polymer to a softened polymer or a liquid polymer is greater than a downhole temperature.

12. The swellable metal assembly of claim 9, wherein the reactive metal is selected from magnesium, a magnesium alloy, calcium, a calcium alloy, aluminum, an aluminum alloy, or a combination thereof.

13. The swellable metal assembly of claim 9, wherein the polymer comprises a thermoplastic polyurethane, a thermoplastic vulcanizate, or a combination thereof.

14. The swellable metal assembly of claim 9, wherein the polymer comprises acrylic, ABS, nylon, PLA, polybenzimidazole, polycarbonate, polyether sulfone, polyoxymethylene, polyetherether ketone, polyetherimide, polyethylene, polyphenylene oxide, polyphenylene sulfide, polypropylene, polystyrene, polyvinyl chloride, polyvidnylidene fluoride, polytetrafluoroethylene, or a combination thereof.

15. The swellable metal assembly of claim 9, wherein the polymer comprises an uncured elastomer.

16. The swellable metal assembly of claim 9, wherein the reactive metal is an annular sleeve configured such that an inner surface of the reactive metal faces an outer surface of the oilfield tubular, and wherein the polymer i) is a polymer ring located in a groove of the annular sleeve, ii) is an endcap placed on an end of the annular sleeve, iii) is a polymer sleeve having holes formed therein, wherein the polymer sleeve is placed around the annular sleeve, or iv) is a tape applied to the annular sleeve.

17. The swellable metal assembly of claim 9, wherein the reactive metal is a cylindrical or spherical solid body having an outer diameter that is less than an inner diameter of the oilfield tubular.

18. A swellable metal system for use in a wellbore, comprising:

an oilfield tubular; and a swellable metal assembly placed around or inside the oilfield tubular in a first configuration, wherein the swellable metal assembly is configured to contact an inner wall of a wellbore or inside the oilfield tubular in a second configuration;

wherein the swellable metal assembly comprises:

a reactive metal, and a polymer in contact with at least a portion of the reactive metal; and wherein the reactive metal is configured to react with a wellbore fluid to form a metal hydroxide in-situ of the wellbore, and wherein the polymer has a phase change temperature such that the polymer is configured to phase change upon exposure to a heat of reaction of the reactive metal with the wellbore fluid.

19. The method of claim 1, wherein the inner wall of the wellbore is an inner surface of a casing or a formation.

* * * * *